US009441498B2

(12) United States Patent
Edwards et al.

(10) Patent No.: US 9,441,498 B2
(45) Date of Patent: Sep. 13, 2016

(54) PROCESS AND TOOL FOR ALIGNING A SEAL HOUSING ASSEMBLY WITH A CASING OF A GAS TURBINE ENGINE

(71) Applicants: James B. Edwards, Sanford, FL (US); Derek A. Bird, Oviedo, FL (US); Antje Greif, Winter Springs, FL (US); Scott W. Krause, Riverton, WY (US)

(72) Inventors: James B. Edwards, Sanford, FL (US); Derek A. Bird, Oviedo, FL (US); Antje Greif, Winter Springs, FL (US); Scott W. Krause, Riverton, WY (US)

(73) Assignee: SIEMENS ENERGY, INC., Orlando, FL (US)

( * ) Notice: Subject to any disclaimer, the term of this patent is extended or adjusted under 35 U.S.C. 154(b) by 311 days.

(21) Appl. No.: 14/066,757

(22) Filed: Oct. 30, 2013

(65) Prior Publication Data

US 2015/0115534 A1 Apr. 30, 2015

(51) Int. Cl.

| | |
|---|---|
| ***F01D 11/02*** | (2006.01) |
| ***B25B 27/00*** | (2006.01) |
| ***F01D 25/24*** | (2006.01) |
| ***F01D 25/28*** | (2006.01) |
| ***F01D 25/26*** | (2006.01) |

(52) U.S. Cl.

CPC ..... *F01D 11/02* (2013.01); *B25B 27/0028* (2013.01); *F01D 25/243* (2013.01); *F01D 25/265* (2013.01); *F01D 25/285* (2013.01); *F05D 2230/644* (2013.01); *F05D 2260/30* (2013.01); *Y10T 29/53978* (2015.01)

(58) Field of Classification Search

CPC .. B23P 19/10; B23P 19/12; Y10T 29/49321; Y10T 29/49963; Y10T 29/49778; Y10T 29/4978; Y10T 29/53; F01D 11/02; F01D 25/285; F01D 25/265; F01D 25/243; F01D 11/00; B25B 27/0028; B25B 27/02; B25B 27/06; F05D 2260/30; F05D 2230/644; F05D 2240/55

USPC ..... 29/255, 252, 278

See application file for complete search history.

(56) References Cited

U.S. PATENT DOCUMENTS

| | | | | |
|---|---|---|---|---|
| 3,628,884 | A | 12/1971 | Mierley, Sr. | |
| 5,228,181 | A | 7/1993 | Ingle | |
| 5,560,091 | A | 10/1996 | Labit, Jr. | |
| 5,709,388 | A | 1/1998 | Skinner et al. | |
| 7,419,355 | B2 * | 9/2008 | Burdgick | F01D 25/243 415/209.2 |
| 7,798,767 | B2 | 9/2010 | Kondo et al. | |
| 8,142,150 | B2 * | 3/2012 | Frick | F01D 25/24 415/214.1 |
| 8,960,748 | B2 * | 2/2015 | Scott | B25B 27/16 248/309.1 |
| 8,998,578 | B2 * | 4/2015 | Rauch | F01D 25/162 415/214.1 |
| 2005/0060865 | A1 | 3/2005 | Jarema | |
| 2011/0268579 | A1 | 11/2011 | Light et al. | |
| 2013/0022453 | A1 | 1/2013 | Schaus et al. | |
| 2013/0230392 | A1 | 9/2013 | Hashimoto | |
| 2014/0338165 | A1 * | 11/2014 | Edwards | B23P 19/10 29/252 |

FOREIGN PATENT DOCUMENTS

EP 2407646 A1 1/2012

* cited by examiner

*Primary Examiner* — David Bryant
*Assistant Examiner* — Lawrence Averick

(57) ABSTRACT

A process is provided for aligning a seal housing assembly with a casing of a gas turbine engine. The casing may comprise a plurality of connecting portions and the seal housing assembly may comprise a plurality of connecting sections. The process may comprise: providing an adjustment tool comprising: a main housing including a first bore and a threaded bore, a first bolt capable of extending through the first bore, and a second bolt capable of threadedly engaging the threaded bore. The process may further comprise mounting the adjustment tool to one of the seal housing assembly connecting sections via the first bolt and adjusting the position of the seal housing assembly relative to the casing by causing the second bolt to move.

6 Claims, 6 Drawing Sheets

PROCESS AND TOOL FOR ALIGNING A SEAL HOUSING ASSEMBLY WITH A CASING OF A GAS TURBINE ENGINE

FIELD OF THE INVENTION

The present invention relates to a process for aligning a seal housing assembly with a casing of a gas turbine engine.

BACKGROUND OF THE INVENTION

In a known gas turbine engine, a seal housing assembly is coupled to a compressor-combustor casing of the gas turbine engine. A rotor extends through the seal housing assembly. A plurality of circumferentially spaced apart bores, for receiving cooling air, are provided in the rotor and located axially between the last row of blades in a compressor section and a first row of blades in a turbine section. Cooling air travels into the rotor through these bores and moves axially through the rotor to blades coupled to the rotor for cooling same. First and second circumferentially extending ring-shaped metal seals are defined in an outer surface of the rotor and positioned respectively fore and aft of the cooling air-receiving bores provided in the rotor. Corresponding third and fourth ring-shaped metal seals are provided on an inner surface of a torque tube seal housing defining a portion of the seal housing assembly.

After a gas turbine engine upgrade, such as when a main engine casing is replaced, the torque tube seal housing is aligned or positioned relative to the casing such that the seals on the torque tube seal housing are correctly positioned or spaced relative to the corresponding seals on the rotor. Previously, to effect such a radial alignment, 4 inch×4 inch wood boards together with hydraulic jacks were used. This radial alignment process was difficult to implement and inefficient.

SUMMARY OF THE INVENTION

In accordance with a first aspect of the present invention, a process is provided for radially aligning a seal housing assembly with a casing of a gas turbine engine. The casing may comprise a plurality of connecting portions and the seal housing assembly may comprise a plurality of connecting sections. The process may comprise: providing an adjustment tool comprising: a main housing including a first bore and a threaded bore, a first bolt capable of extending through the first bore, and a second bolt capable of threadedly engaging the threaded bore. The process may further comprise mounting the adjustment tool to one of the seal housing assembly connecting sections via the first bolt and adjusting the position of the seal housing assembly relative to the casing by causing the second bolt to move so as to apply a force against the casing causing the main housing and the seal housing assembly to move relative to the casing.

The first bore may comprise a first through bore (i.e., not threaded). The adjustment tool may further comprise a third bolt capable of extending through a second through bore in the main housing. Mounting the adjustment tool may comprise mounting the adjustment tool to the one connecting section via the first and third bolts.

The first and third bolts may be threadedly received in corresponding threaded bores in the one connecting section.

The adjustment tool main housing may comprise first and second generally planar parts positioned generally orthogonal to one another. The first and second through bores may be provided in the first part and the threaded bore may be provided in the second part.

The seal housing assembly may comprise a plurality of radially extending arms, wherein each of the connecting sections is coupled to a distal end of a corresponding one of the radially extending arms. The main housing first part may further comprise a slot for receiving a corresponding one of the radially extending arms.

The first and second through bores in the first part may be positioned on opposite sides of the slot in the first part.

In accordance with a second aspect of the present invention, a process is provided for aligning a seal housing assembly with a casing of a gas turbine engine. The casing may comprise a plurality of connecting portions and the seal housing assembly may comprise a plurality of connecting sections. The process may comprise: providing a plurality of adjustment tools, each of the tools comprising: a main housing including a first bore and threaded bore, a first bolt capable of extending through the first bore, and a second bolt capable of threadedly engaging the threaded bore. The process may further comprise: mounting each of the adjustment tools to a corresponding one of the seal housing assembly connecting sections via the corresponding adjustment tool first bolt; and adjusting the position of the seal housing assembly relative to the casing by causing the second bolt of at least one of the adjustment tools to rotate so as to apply a force against the casing causing the seal housing assembly to move relative to the casing.

The first bore may comprise a first through bore. Each of the adjustment tools may further comprise a third bolt capable of extending through a second through bore in the main housing. Mounting may comprise mounting each adjustment tool to a corresponding one of the seal housing assembly connecting sections via the adjustment tool first and third bolts.

The first and third bolts of each adjustment tool may be threadedly received in corresponding threaded bores in the corresponding one connecting section.

The main housing of each of the adjusting tools may comprise first and second generally planar parts positioned generally orthogonal to one another. The first and second through bores may be provided in the first part and the threaded bore may be provided in the second part.

The seal housing assembly may comprise a plurality of radially extending arms, wherein each of the connecting sections may be coupled to a distal end of a corresponding one of the radially extending arms. The main housing first part of each of the adjusting tools may further comprise a slot for receiving a corresponding one of the radially extending arms.

The first and second through bores in the first part may be positioned on opposite sides of the slot in the first part.

In accordance with a third aspect of the present invention, an adjustment tool is provided for aligning a seal housing assembly with a casing of a gas turbine engine. The casing may comprise a plurality of connecting portions and the seal housing assembly may comprise a plurality of connecting sections. The tool may comprise: a main housing including first and second generally planar parts, the first part having a first bore and the second part having a threaded bore; a first bolt extending through the first bore and being adapted to threadedly engage a bore in one of the seal housing assembly connecting sections; and a second bolt threadedly engaging the threaded bore. The second bolt may extend generally orthogonal to the first bolt.

The adjustment tool may further comprise a third bolt capable of extending through a third bore in the first part of the main housing.

The main housing first part may further comprise a slot for receiving a corresponding one of the radially extending arms.

The first and second bores in the first part may be positioned on opposite sides of the slot in the first part.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
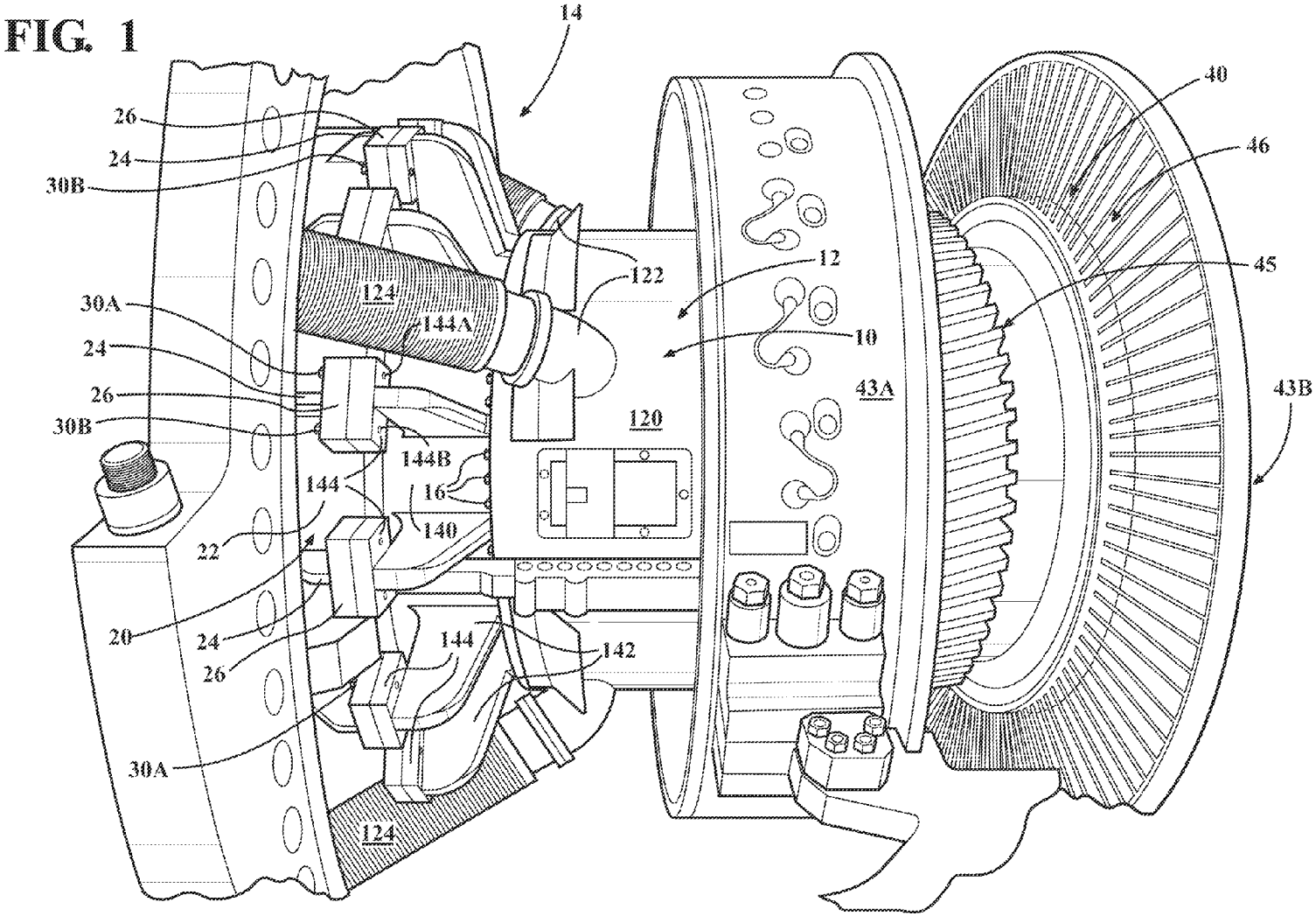
FIG. 1 is a side view of a seal housing assembly coupled to a compressor-combustor casing.

In FIG. 1, a seal housing assembly 10 of a gas turbine engine is illustrated. The seal housing assembly 10 comprises a generally cylindrical torque tube seal housing 12 and a compressor diffuser 14. The torque tube seal housing 12 is coupled to the compressor diffuser 14 by bolts 16. The torque tube seal housing 12 comprises a main cylinder 120 having a plurality of openings 120A, first and second side seal structures 124A and 124B extending radially inward from the main cylinder 120, and a plurality of cooling air inlets 122 coupled to the main cylinder 120 so as to communicate with the openings 120A, see FIGS. 1, 3 and 4. Cooling air supply tubes 124 are coupled to the inlets 122 for supplying cooling air to the inlets 122 from an air supply source (not shown).

Figure 2:
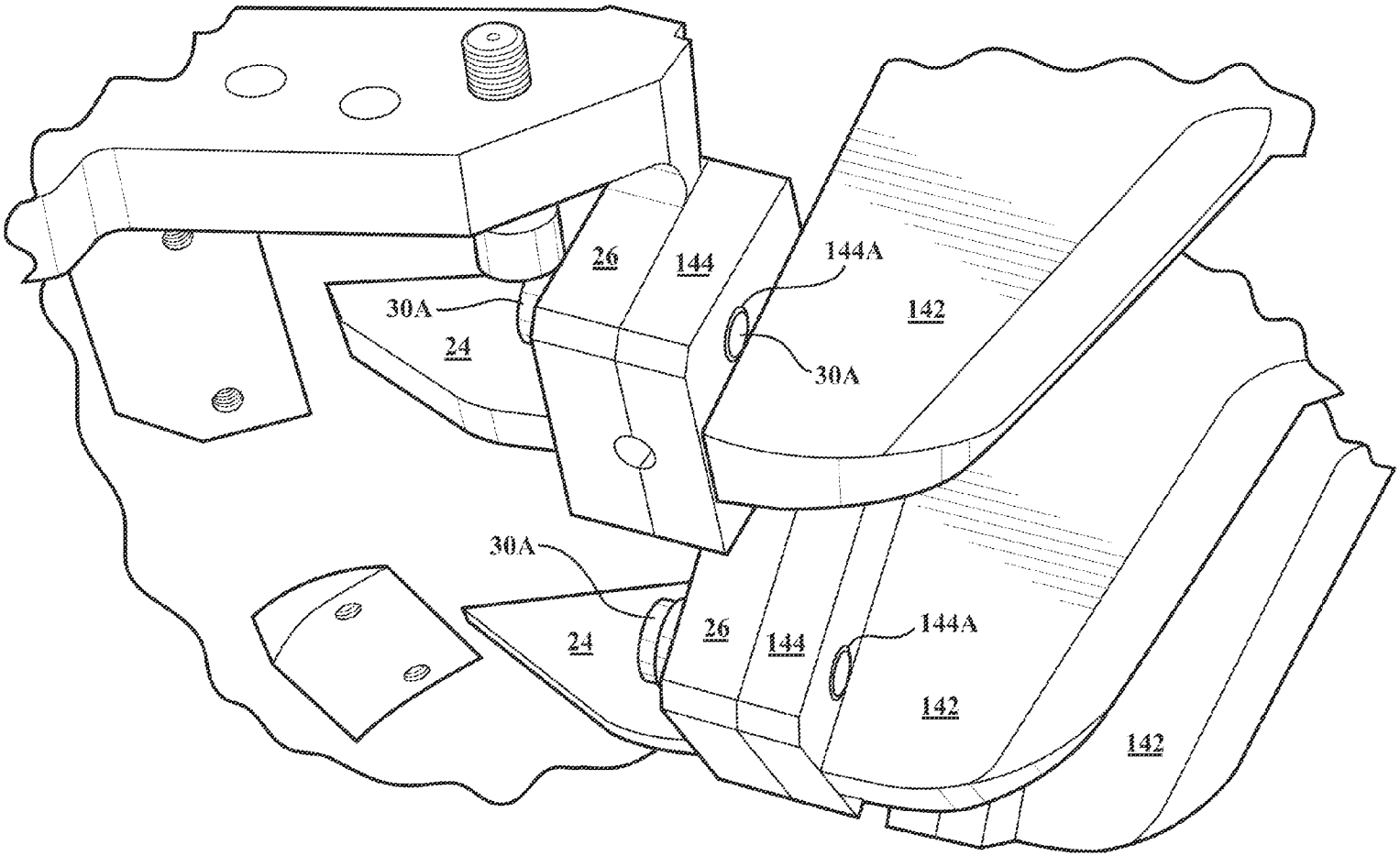
FIG. 2 is a perspective view of radially extending arms and connecting sections of a compressor diffuser and connecting portions of the casing coupled to the connecting sections.
Figure 4:
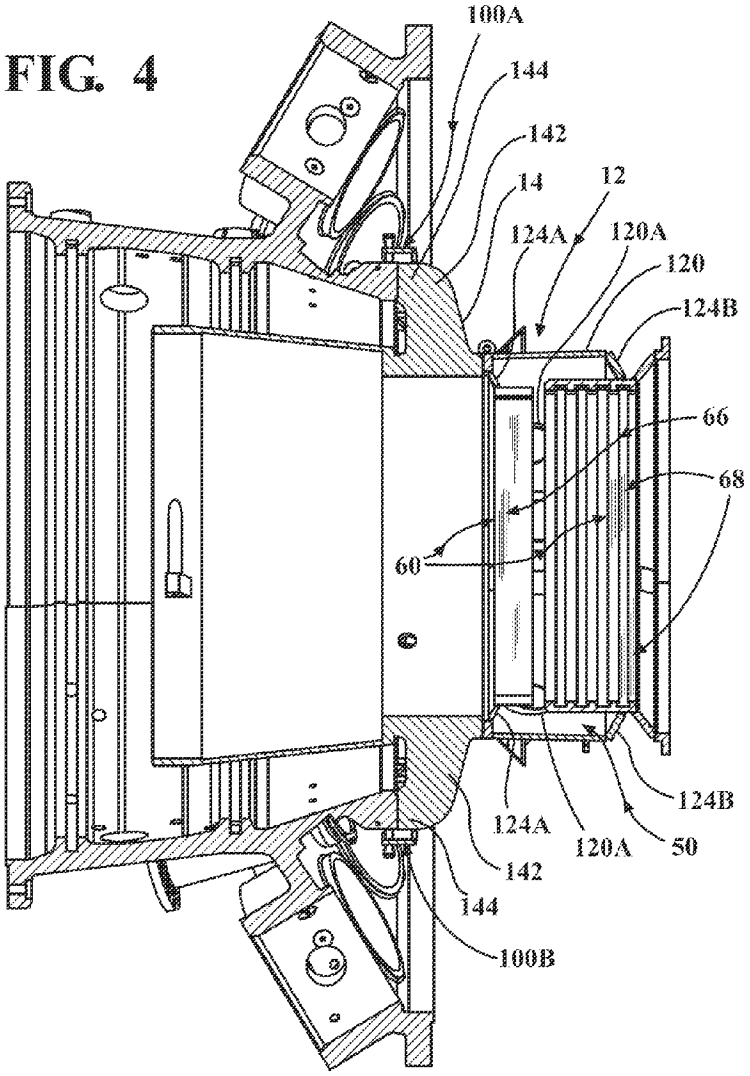
FIG. 4 is a cross sectional view of the seal housing assembly coupled to the casing.

The compressor diffuser 14 comprises a main cylindrical portion 140, a plurality of radially extending arms 142 extending from the cylindrical portion 140 and connecting sections or flanges 144 coupled to distal ends of the arms 142, see FIGS. 1, 2 and 4. The gas turbine engine further comprises a fixed compressor-combustor casing 20 comprising a main body portion 22, a plurality of outwardly extending supports 24 coupled to the main body portion 22 and a plurality of connecting portions or flanges 26 coupled to the supports 24 and the main body portion 22.

Figure 7:
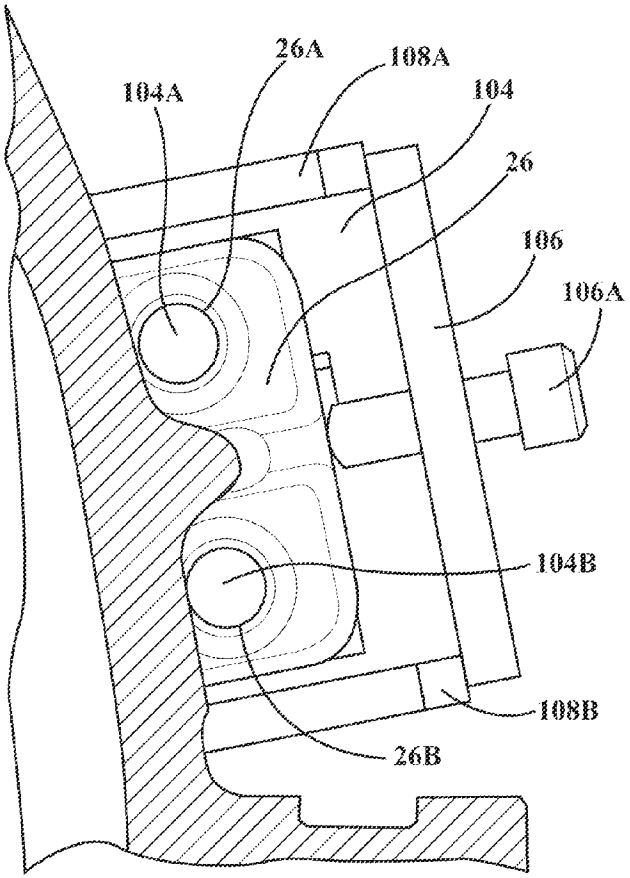
FIG. 7 is a view illustrating a bolt of the alignment tool applying a force onto the casing to effect a radial alignment of the seal housing assembly relative to the casing.
Figure 6:
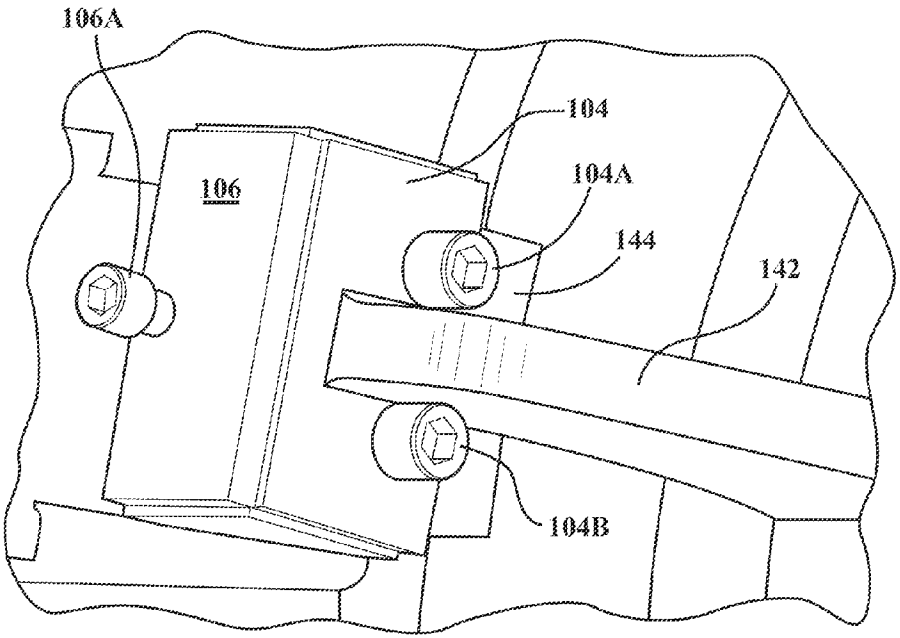
FIG. 6 is a perspective view of the tool coupled to a connecting section of the compressor diffuser.
Figure 8:
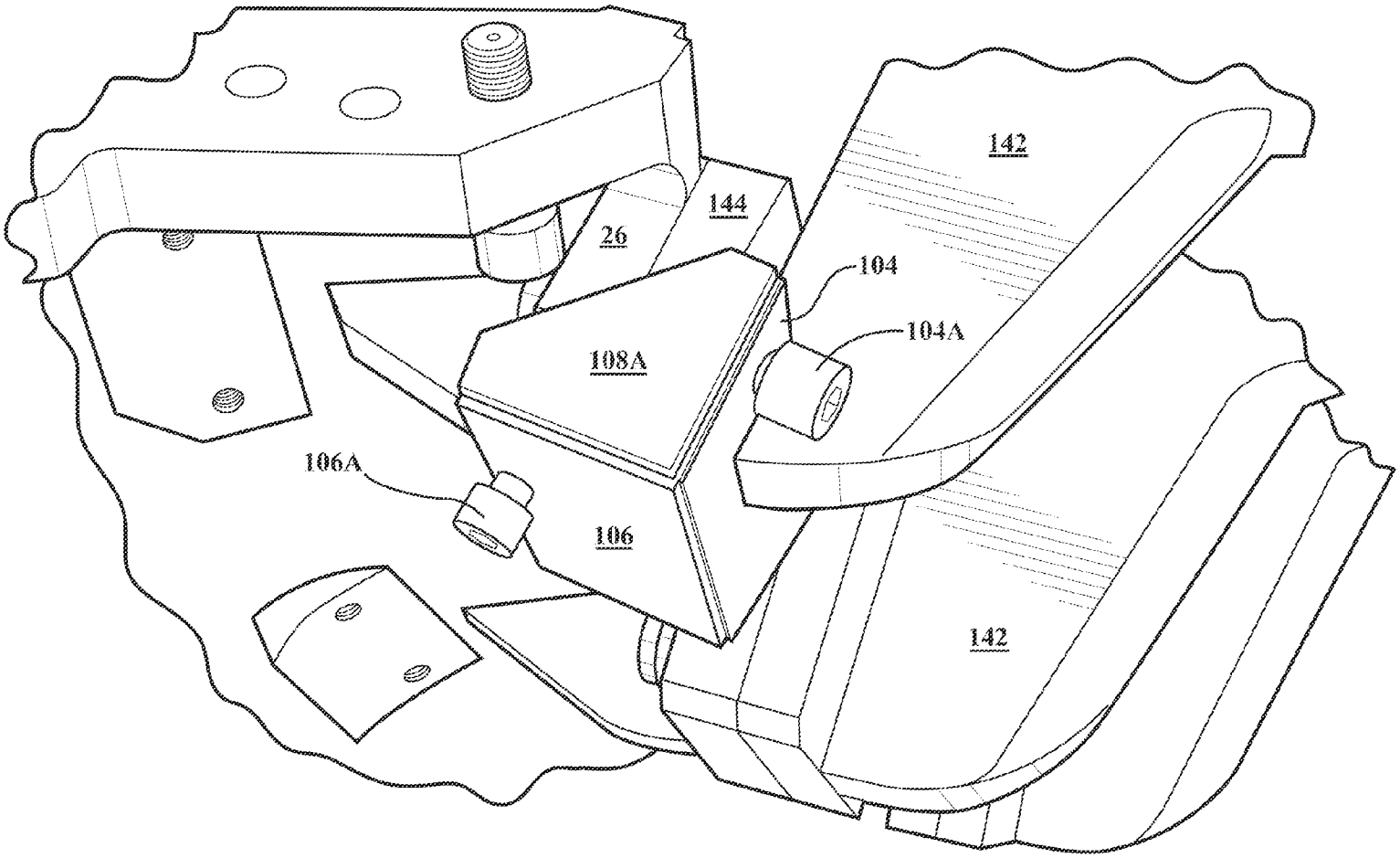
FIG. 8 is a perspective view of the alignment tool coupled to a connecting section of the compressor diffuser.

Each connecting section 144 comprises first and second threaded bores 144A and 144B, see FIGS. 1 and 2. Each connecting portion 26 comprises first and second through openings 26A and 26B, see FIG. 7, generally aligned respectively with the first and second bores 144A and 144B. First and second bolts 30A and 30B are provided for coupling the seal housing assembly 10 to the fixed compressor-combustor casing 20. The first bolts 30A pass through corresponding first openings 26A in the connecting portions 26 of the compressor-combustor casing 20 and threadedly engage corresponding first bores 144A in the connecting sections 144 of the compressor diffuser 14. The second bolts 30B pass through corresponding second openings 26B in the connecting portions 26 and threadedly engage second bores 144B in the connecting sections 144.

Figure 3:
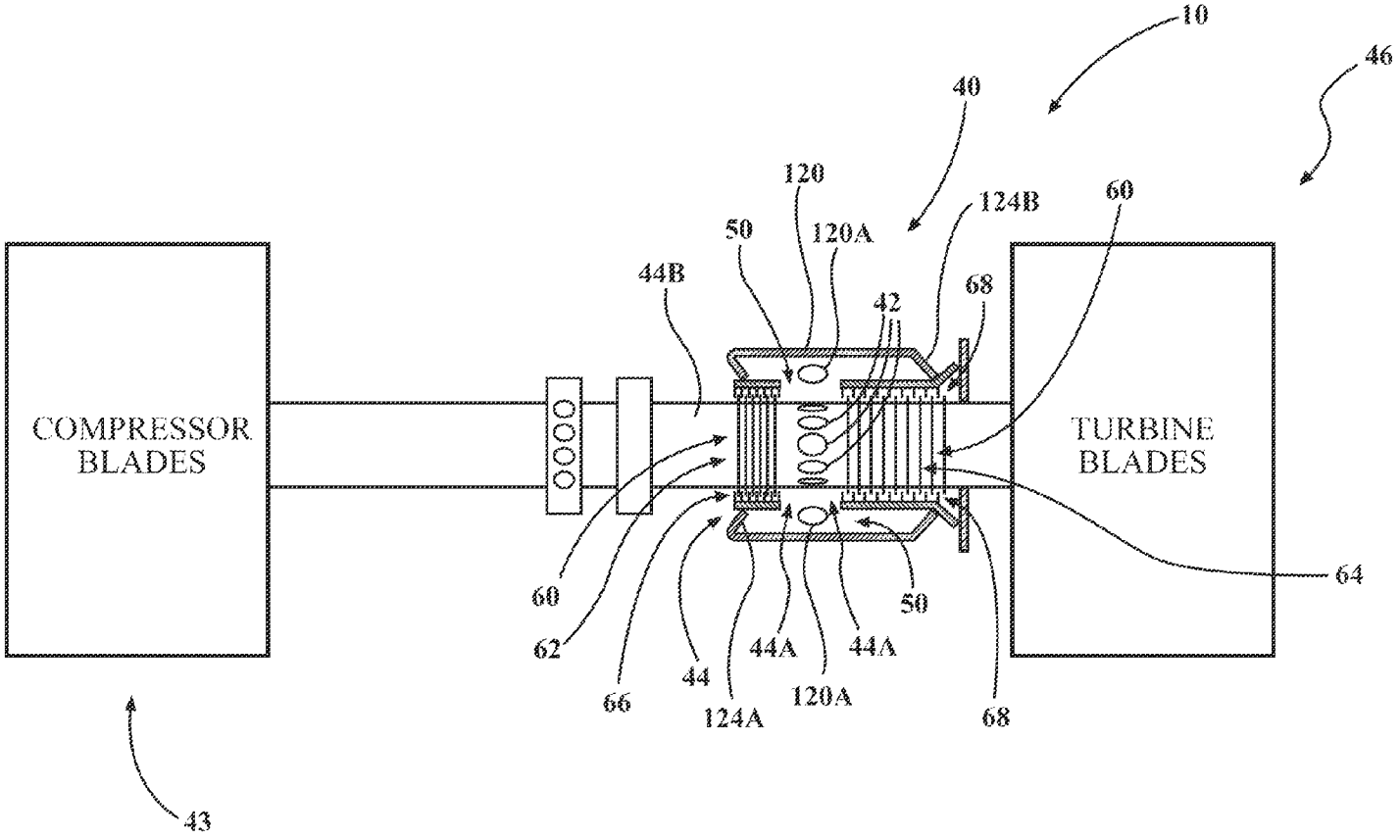
FIG. 3 is a schematic view of a rotor with a torque tube seal housing shown in section and positioned about the rotor.
Figure 5:
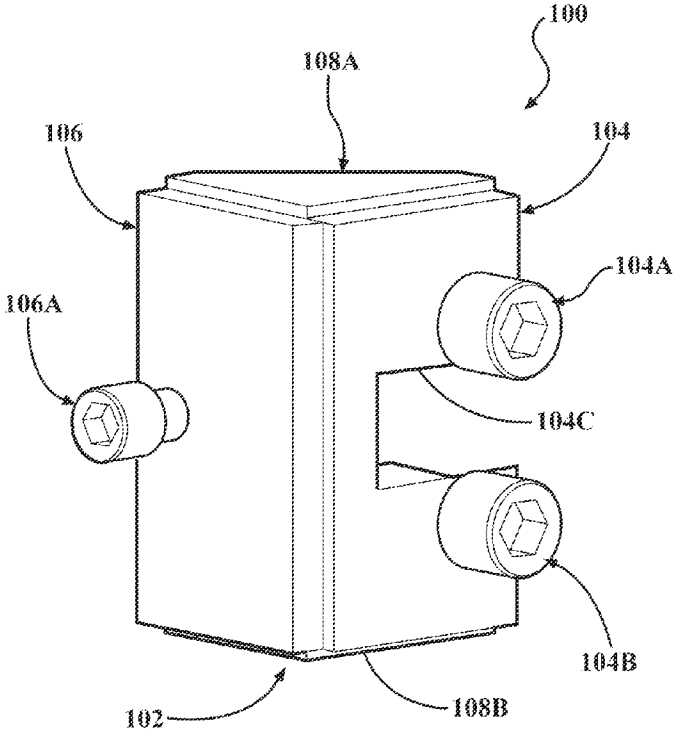
FIG. 5 is a perspective view of an alignment tool of the present invention.

When the engine is fully assembled, a rotor 40 extends through the fixed seal housing assembly 10 and is rotatable relative to the seal housing assembly 10, see FIGS. 1 and 3 (the compressor diffuser 14 is not illustrated in FIG. 3). A plurality of circumferentially spaced apart bores 42 (covered by the torque tube seal housing 12 in FIG. 1 and shown in FIG. 3) are provided in a main cylindrical portion 44 of the rotor 40 and located axially between the last row of blades in a compressor section 43 and a first row of blades (a first blade row cover 43A, a rotor disk 45 of a second row of blades and a third row 43B of blades are illustrated in FIG. 1) in a turbine section 46.

Cooling air travels from the air supply source, through the cooling air supply tubes 124 and then into the inlets 122. From the inlets 122, the cooling air moves through the torque tube seal housing main cylinder openings 120A into an inner cavity 50 defined by the torque tube seal housing main cylinder 120, the first and second side seal structures 124A and 124B, a section 44A of an outer surface 44B of the rotor main cylindrical portion 44 and seal structure 60, see FIG. 3.

The seal structure 60 comprises a plurality of first circumferentially extending ring-shaped metal labyrinth seals 62 and a plurality of second circumferentially extending ring-shaped metal labyrinth seals 64, both defined in the outer surface 44B of the main cylindrical portion 44 of the rotor 40 and positioned respectively fore and aft of the cooling air-receiving bores 42 provided in the rotor 40. The seal structure 60 further comprises a plurality of third circumferentially extending ring-shaped metal labyrinth seals 66 and a plurality of fourth circumferentially extending ring-shaped metal labyrinth seals 68, both extending radially inwardly from an inner surface of the torque tube seal housing main cylinder 120, see FIGS. 3 and 4. The third labyrinth seals 66 are positioned opposite of the first seals 62 and interact with the first seals 62 to prevent hot working gases from entering the inner cavity 50. Likewise, the fourth labyrinth seals 68 are positioned opposite of the second seals 64 and interact with the second seals 64 so as to prevent hot working gases from entering the inner cavity 50. Cooling air travels from the inner cavity 50 into the rotor 40 via the rotor bores 42 and moves axially through the rotor 40 to blades coupled to the rotor 40 for cooling same.

After a gas turbine engine upgrade, such as when a main engine casing, which casing includes the compressor-combustor casing 20, is replaced, the seal housing assembly 10 is aligned radially relative to the casing 20 and/or the rotor 40 such that the third and fourth seals 66 and 68 on the torque tube seal housing 12 are generally radially aligned respectively with the first and second seals 62 and 64 on the rotor 40. In the illustrated embodiment, the rotor 40 is not positioned within the seal housing assembly 10 during the alignment process. However, it is contemplated that an alignment operation may take place when the rotor 40 is located within the seal housing assembly 10. In the illustrated embodiment, radial alignment is generally achieved when the torque tube seal housing 12 is generally centered relative to the compressor-combustor casing 20 such that the gap between the first and third seals 62 and 66 and between the second and fourth seals 64 and 68 will be generally consistent along generally the entire 360 degree span of those seals. It is presumed that the rotor 40 does not substantially move radially relative to the compressor-combustor casing 20 during normal operation while the rotor 40 is rotating.

In accordance with the present invention, a plurality of adjustment tools 100, see FIGS. 5-8, and a process for using the adjustment tools 100, are provided for radially aligning the seal housing assembly 10 with the compressor-combustor casing 20 and/or rotor 40. The adjustment tools 100 in the illustrated embodiment are constructed in the same manner. Hence, only one adjustment tool 100 will be described herein in detail.

The adjustment tool 100 comprises in the illustrated embodiment a main housing 102 including first and second generally planar parts 104 and 106, see FIGS. 5-8. The first part 104 comprises first and second non-threaded or through bores through which first and third bolts 104A and 104B extend. The second part 106 comprises a threaded bore for receiving a second bolt 106A. First and second side support plates 108A and 108B are welded to the first and second parts 104 and 106 to increase the strength and rigidity of the tool 100. The first part 104 comprises a slot 104C for receiving a corresponding radially extending arm 142, see FIG. 6. The first and third bolts 104A and 104B are positioned on opposite sides of the slot 104C.

The adjustment tool 100 is coupled to a corresponding connecting section 144 as follows. The tool 100 is positioned over a corresponding extending arm 142 and then coupled to the corresponding connecting section 144 by passing the first and third bolts 104A and 104B through the first and second through bores in the first part 104 such that the bolts 104A and 104B threadedly engage the first and second threaded bores 144A and 144B in the connecting section 144, see FIGS. 6 and 8. The bolts 104A and 104B preferably do not extend into the openings 26A and 26B in the corresponding connecting portion 26, see FIG. 7.

In the illustrated embodiment, to effect radial alignment of the seal housing assembly 10, including the torque tube seal housing 12, with the compressor-combustor casing 20, first, second, third and fourth adjustment tools 100 are coupled to corresponding connecting sections 144 of the seal housing assembly compressor diffuser 14 so as to be circumferentially spaced apart approximately 90 degrees. In FIG. 4, first and second adjustment tools 100A and 100B are shown at approximately 90 and 270 degree locations. Third and fourth adjustment tools (not shown) may be positioned at approximately 0 and 180 degree locations. Appropriate measuring or gauging tooling (not shown) is used to measure the radial location of the seal housing assembly 10 relative to the casing 20. Again, it is presume that the radial location of the rotor 40 relative to the compressor-combustor casing 20 does not change substantially during normal operation with the rotor 40 rotating.

To effect movement of the seal housing assembly 10 relative to the casing 20, one or more of the second bolts 106A of one or more of the adjustment tools 100 is adjusted, i.e., turned. When a second bolt 106A is rotated, it applies a force against, i.e., pushes against, the connecting portion 26 causing its corresponding main housing 102 and an adjacent section of the seal housing assembly 10 to move in an opposite direction, i.e., away from the connecting portion 26. The second bolts 106A are adjusted until the seal housing assembly 10 is generally radially aligned relative to the casing 20 such that the third and fourth seals 66 and 68 on the torque tube seal housing 12 will be generally radially aligned respectively with the first and second seals 62 and 64 on the rotor 40. Thereafter, the adjustment tools 100 are removed from the connecting sections 144. The seal housing assembly 10 is then secured to the casing 20 via first bolts 30A passing through corresponding first openings in the connecting portions 26 and threadedly engaging corresponding first bores 144A in the connecting sections 144 and second bolts 30B passing through corresponding second openings in the connecting portions 26 and threadedly engaging second bores 144B in the connecting sections 144.

If an alignment operation takes place when the rotor 40 is located within the seal housing assembly 10, appropriate measuring or gauging tooling (not shown) may be used to measure the radial location of the seal housing assembly 10 relative to the rotor 40. The second bolts 106A may be adjusted until the seal housing assembly 10 is generally radially aligned relative to the rotor 40 and/or the casing 20 such that the third and fourth seals 66 and 68 on the torque tube seal housing 12 are generally radially aligned respectively with the first and second seals 62 and 64 on the rotor 40.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for aligning a seal housing assembly with a casing of a gas turbine engine, the casing comprising a plurality of connecting portions and the seal housing assembly comprising a plurality of connecting sections, the process comprising:

providing an adjustment tool comprising:

a main housing including a first bore and a threaded bore, a first bolt capable of extending through the first bore, and a second bolt capable of threadedly engaging the threaded bore;

mounting the adjustment tool to one of the seal housing assembly connecting sections via the first bolt;

adjusting the position of the seal housing assembly relative to the casing by causing the second bolt to rotate so as to apply a force against the casing causing the main housing and the seal housing assembly to move relative to the casing, wherein the first bore comprises a first through bore and the adjustment tool further comprises a third bolt capable of extending through a second through bore in the main housing, said mounting comprises mounting the adjustment tool to the one connecting section via the first and third bolts, wherein the first and third bolts are threadedly received in corresponding threaded bores in the one connecting section, and wherein the adjustment tool main housing comprises first and second generally planar parts positioned generally orthogonal to one another, the first and second bores being provided in the first part and the threaded bore being provided in the second part.

2. The process as set out in claim 1, wherein the seal housing assembly comprises a plurality of radially extending arms, each of the connecting sections being coupled to a distal end of a corresponding one of the radially extending arms, the main housing first part further comprising a slot for receiving a corresponding one of the radially extending arms.

3. The process as set out in claim 2, wherein the first and second bores in the first part are positioned on opposite sides of the slot in the first part.

4. A process for aligning a seal housing assembly with a casing of a gas turbine engine, the casing comprising a plurality of connecting portions and the seal housing assembly comprising a plurality of connecting sections, the process comprising:

providing a plurality of adjustment tools, each of the tools comprising:

a main housing including a first bore and a threaded bore, a first bolt capable of extending through the first bore, and a second bolt capable of threadedly engaging the threaded bore;

mounting each of the adjustment tools to a corresponding one of the seal housing assembly connecting sections via the corresponding adjustment tool first bolt;

adjusting the position of the seal housing assembly relative to the casing by causing the second bolt of at least one of the adjustment tools to rotate so as to apply a force against the casing causing the seal housing assembly to move relative to the casing, wherein the first bore comprises a first through bore and each of the adjustment tools further comprises a third bolt capable of extending through a second through bore in the main housing, said mounting comprises mounting each adjustment tool to a corresponding one of the seal housing assembly connecting sections via the adjustment tool first and third bolts, wherein the first and third bolts of each adjustment tool are threadedly received in corresponding threaded bores in the corresponding one connecting section, and wherein the main housing of each of the adjusting tools comprises first and second generally planar parts positioned generally orthogonal to one another, the first and second bores being provided in the first part and the threaded bore being provided in the second part.

5. The process as set out in claim 4, wherein the seal housing assembly comprises a plurality of radially extending arms, each of the connecting sections being coupled to a distal end of a corresponding one of the radially extending arms, the main housing first part of each of the adjusting tools further comprising a slot for receiving a corresponding one of the radially extending arms.

6. The process as set out in claim 5, wherein the first and second bores in the first part are positioned on opposite sides of the slot in the first part.

* * * * *